US005267646A

United States Patent [19]

Inoue et al.

[11] Patent Number: 5,267,646

[45] Date of Patent: Dec. 7, 1993

[54] CONTAINERS HAVING PLURALITY OF CHAMBERS

[75] Inventors: Fujio Inoue, Naruto; Yasuo Furuta, Tokushima; Shigetoshi Kashiyama, Naruto, all of Japan

[73] Assignee: Otsuka Pharmaceutical Factory, Inc., Naruto, Japan

[21] Appl. No.: 861,985

[22] PCT Filed: Oct. 28, 1991

[86] PCT No.: PCT/JP91/01465

§ 371 Date: Jun. 30, 1992

§ 102(e) Date: Jun. 30, 1992

[87] PCT Pub. No.: WO92/08434

PCT Pub. Date: May 29, 1992

[30] Foreign Application Priority Data

| | | | |
|---|---|---|---|
| Nov. 7, 1990 | [JP] | Japan | 2-303709 |
| Mar. 2, 1991 | [JP] | Japan | 3-61192 |
| Mar. 25, 1991 | [JP] | Japan | 3-86190 |
| Sep. 25, 1991 | [JP] | Japan | 3-274848 |
| Sep. 25, 1991 | [JP] | Japan | 3-274849 |

[51] Int. Cl.[5] ..... B65D 81/32

[52] U.S. Cl. ..... 206/204; 206/205; 206/219; 206/568; 604/416

[58] Field of Search ..... 206/219-222, 206/568, 204, 205, 213.1; 604/408, 410, 416

[56] References Cited

U.S. PATENT DOCUMENTS

| | | | |
|---|---|---|---|
| 3,847,279 | 11/1974 | Montgomery . | |
| 4,458,811 | 7/1984 | Wilkinson . | |
| 4,462,224 | 7/1984 | Dunshee et al. | 206/219 |
| 4,583,971 | 4/1986 | Bocquet et al. . | |
| 4,592,092 | 5/1986 | McPhee | 604/415 |
| 4,602,910 | 7/1986 | Larkin . | |
| 4,608,043 | 8/1986 | Larkin . | |
| 4,614,267 | 9/1986 | Larkin . | |
| 4,731,053 | 3/1988 | Hoffman . | |
| 4,834,152 | 5/1989 | Howson et al. | 604/415 |
| 4,836,397 | 6/1989 | Fowles | 604/415 |
| 4,872,553 | 10/1989 | Suzuki et al. . | |
| 4,936,841 | 6/1990 | Aoki et al. . | |
| 4,961,495 | 10/1990 | Yoshida et al. . | |
| 4,998,400 | 3/1991 | Suzuki et al. . | |
| 5,108,387 | 4/1992 | Falk et al. | 604/415 |
| 5,137,527 | 8/1992 | Miller et al. | 604/415 |
| 5,176,634 | 1/1993 | Smith et al. | 206/219 |

FOREIGN PATENT DOCUMENTS

| | | | |
|---|---|---|---|
| 263571 | 4/1988 | European Pat. Off. . | |
| 0327519 | 9/1989 | European Pat. Off. . | |
| 0327519 | 9/1989 | European Pat. Off. . | |
| 389621 | 3/1990 | European Pat. Off. . | |
| 1486639 | 11/1969 | Fed. Rep. of Germany . | |
| 3426465 | 1/1986 | Fed. Rep. of Germany | 206/219 |
| 0576008 | 4/1958 | Italy | 206/219 |
| 57-52455 | 3/1982 | Japan . | |
| 59-126974 | 8/1984 | Japan . | |
| 86-172174 | 10/1984 | Japan . | |
| 61-103823 | 5/1986 | Japan . | |
| 63-135642 | 9/1988 | Japan . | |
| 63-309263 | 12/1988 | Japan . | |
| 91-091594 | 7/1989 | Japan . | |
| 3-37067 | 2/1991 | Japan . | |
| 88/08694 | 11/1988 | PCT Int'l Appl. . | |
| WO92/02271 | 2/1992 | PCT Int'l Appl. . | |

*Primary Examiner*—Jimmy G. Foster

*Attorney, Agent, or Firm*—Armstrong, Westerman, Hattori, McLeland & Naughton

[57] ABSTRACT

A container having a plurality of chambers chiefly for use in the field of medicine. The body of the container is made of flexible plastics and has partition means dividing the container body into the chambers and permitting communication between the chambers when required. The container body comprises container portions forming the plurality of chambers and including at least one container portion having no cover and at least one container portion having a cover. The cover encloses the container portion therewith to form a closed space therein around the container portion and is made of a flexible film having barrier properties against moisture and gas. At least one of a desiccant and an oxygen absorber can accommodated in the closes space. The container is inexpensive, has high quality and is efficient to use and easy to dispose of.

19 Claims, 17 Drawing Sheets

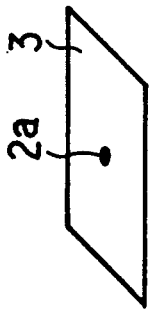
FIG. 6(a)
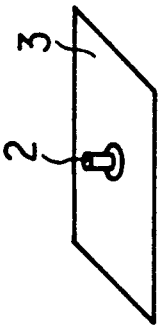
FIG. 6(b)
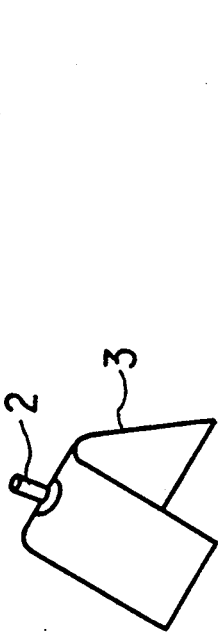
FIG. 6(c)
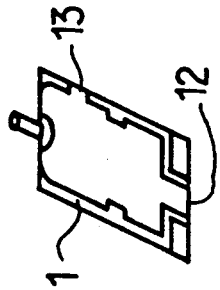
FIG. 6(d)
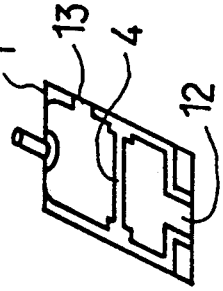
FIG. 6(e)
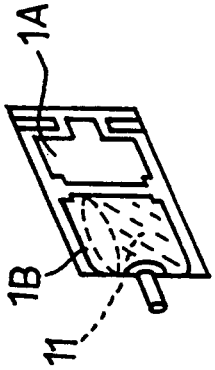
FIG. 6(f)
FIG. 6(g)
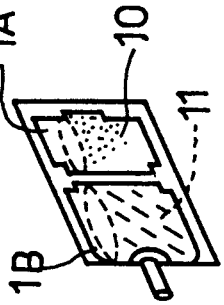
FIG. 6(h)
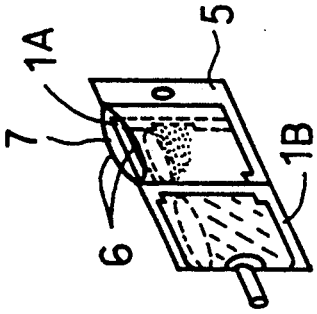
FIG. 6(i)
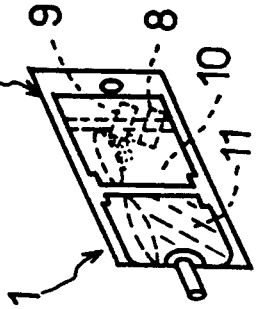
FIG. 6(j)

2a
3

3
2

2
3

2
1
36
35

33
31
32

1A
31
33
32
11
1B 35
1A
1B 10
1A
1A1
1B 5
1
6b
1A
1a
37
7
1B 8
9
5
1

CONTAINERS HAVING PLURALITY OF CHAMBERS

TECHNICAL FIELD

The present invention relates to containers having a plurality of chambers chiefly for use in the field of medicine, and more particularly to flexible containers of plastics having a plurality of chambers for accommodating liquid preparations, powder preparations or solid preparations, and partition means dividing the container into the chambers and permitting communication between the chambers when required.

BACKGROUND ART

Flexible containers of plastics have heretofore been used in the field of medicine which have a plurality of chambers, and partition means dividing the container into the chambers and permitting communication between the chambers. Since such a container is likely to permit penetration of moisture or gas even if in a very small amount, there arises a need to place the container, along with a desiccant, into an expensive outer bag having barrier properties against moisture and gas when the container is used for separately preserving an antibiotic or like medicinal which is hygroscopic and becomes unstable with time, and a liquid preparation such as physiological saline, glucose or like solution or dilution. Nevertheless, the desiccant, which absorbs water from the liquid preparation, fails to fully dry up the hygroscopic medicinal and further causes concentration of the liquid preparation. Because of this drawback, it has not been practice to preserve the hygroscopic and unstable antibiotic or like medicinal and the liquid preparation as separately accommodated in the flexible container of plastics.

For this reason, medicinals, such as antibiotics,,which become unstable with time are preserved in moisture- and gas-impermeable vials or like containers before use. When to be administered to the patient, the medicinal is mixed or diluted with, or dissolved in, physiological saline, glucose solution or like dissolving liquid or diluent which is preserved separately.

However, this method is cumbersome to practice and involves the hazard of contamination with bacteria during the handling procedure. Containers have therefore been developed which comprise a glass val having enclosed therein an unstable antibiotic and a dissolving liquid-containing flexible container portion of plastics joined to the vial in combination therewith, with a piercing needle provided therebetween (see, for example, Unexamined Japanese Patent Publication HEI 2-1277). These containers have the advantage that the contents can be mixed together with ease aseptically, whereas difficulties are encountered in discarding the container because a very cumbersome procedure is needed for separating the container into the glass vial, flexible container portion and piercing implement for disposal. Thus, the container has a problem as the disposal of medical wastes which has attracted attention presently, i.e., the problem of failing to fulfill the requirement of easy disposal.

Also known are containers having a plurality of chambers for accommodating other medicinal which is readily oxidizable, such as amino acid solution containing tryptophan, and a sugar or electrolytic solution (see, for example, Examined Japanese Patent Publication SHO 63-20550). The container of this type must be preserved as placed in an expensive moisture- and gas-barrier outer bag together with an oxygen absorber. In this case, the latter preparation (sugar or electrolytic solution) on which the absorber need not act is also accommodated in the outer bag along with the medicinal. The outer bag therefore requires a larger capacity, an oxygen absorber having an increased capacity to absorb oxygen or an increased amount of absorber, and a larger amount of moisture- and gas-barrier material, hence the drawback of an increased cost.

DISCLOSURE OF THE INVENTION

An object of the present invention is to provide a flexible container of plastics having a plurality of chambers and usable for accommodating and preserving liquid preparations, powder preparations or solid preparations which are hygroscopic or susceptible to oxidation.

Another object of the present invention is to provide such a container which can be prepared with use of a reduced amount of expensive moisture- and gas-barrier film and which is therefore inexpensive.

Another object of the present invention is to provide a container of the type mentioned wherein a desiccant or oxygen absorber can be caused to act only on a liquid, powder or solid preparation which is hygroscopic or susceptible to oxidation.

Still another object of the present invention is to provide a container of the type mentioned which need not include a glass vial and which is therefore easy to dispose of.

Other features of the present invention will become apparent from the following description.

The present invention provides a container having a plurality of chambers for accommodating a liquid, powder or solid and partition means dividing the container into the chambers and permitting communication between the chambers when required, the container being characterized in that the container comprises a flexible container body made of plastics and having container portions, the container portions forming the plurality of chambers and including at least one container portion having no cover and at least one container portion having a cover, the cover enclosing the container portion therewith to form a closed space therein around the container portion and being made of a flexible film having barrier properties against moisture and gas, the closed space being adapted to accommodate therein at least one of a desiccant and an oxygen absorber.

With the container of the present invention, a usual substance, for example, a liquid, powder or solid preparation which is not susceptible to oxidation or hygroscopic, is accommodated in the chamber within the coverless container portion among the container portions of container body made of plastics. Although the coverless container portion is made of plastics and low in gas-barrier properties, the substance accommodated therein can be preserved for a long period of time as in common plastics containers since the substance is a usual one.

On the other hand, a special substance, such as a liquid, powder or solid preparation which is susceptible to oxidation and/or hygroscopic, is accommodated in the chamber within the covered container portion. This container portion is made of plastics, has moisture- and gas-permeability inherent to plastics although very slight and is low in gas-barrier properties. However, the cover enclosing the container portion is made of a special film which is impermeable to moisture and gas, while the closed space between the cover and the container portion has accommodated therein a desiccant and/or an oxygen absorber, so that the special substance can be preserved for a long period of time free of degradation despite the low gas-barrier properties of the plastics container portion.

Accordingly, although made of flexible plastics, the container of the present invention is usable free of any trouble for accommodating medicinals, such as antibiotics, which are hygroscopic and become unstable with time, and liquid preparations such as dissolving solutions or diluents.

The container of the present invention has the gas-impermeable cover of expensive special film, whereas the cover is provided on the container only locally and can therefore be formed with use of a small amount of the expensive special film. With the cover provided thus only locally, the amount of desiccant and/or the oxygen absorber accommodated within the cover can be small. This serves to minimize the rise in the cost of package.

Furthermore, the desiccant and/or the oxygen absorber accommodated in the closed space around the covered container portion can be separated from the coverless container portion by the cover, consequently prevented from acting to absorb moisture or oxygen from the usual substance accommodated in the coverless container portion and from producing an adverse effect thereon such as concentration or reduction.

Moreover, the present container comprises the plastics container body and the cover which are all flexible and readily deformable and is therefore easy to dispose of without the necessity of separating the container into these components.

BRIEF DESCRIPTION OF THE DRAWINGS

FIG. 6(*a*)–(*j*) is a diagram illustrating stepwise another preferred example of process for producing the same;

Figure 1:
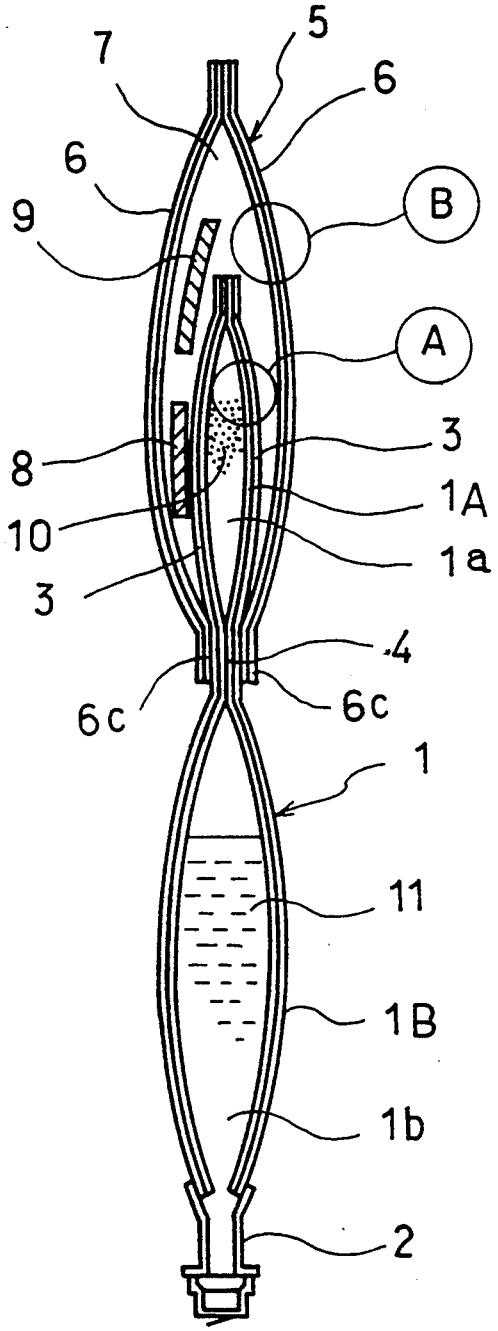
FIG. 1 is an enlarged view in vertical section showing an embodiment of the invention of the type having a single weak seal portion.
Figure 12:
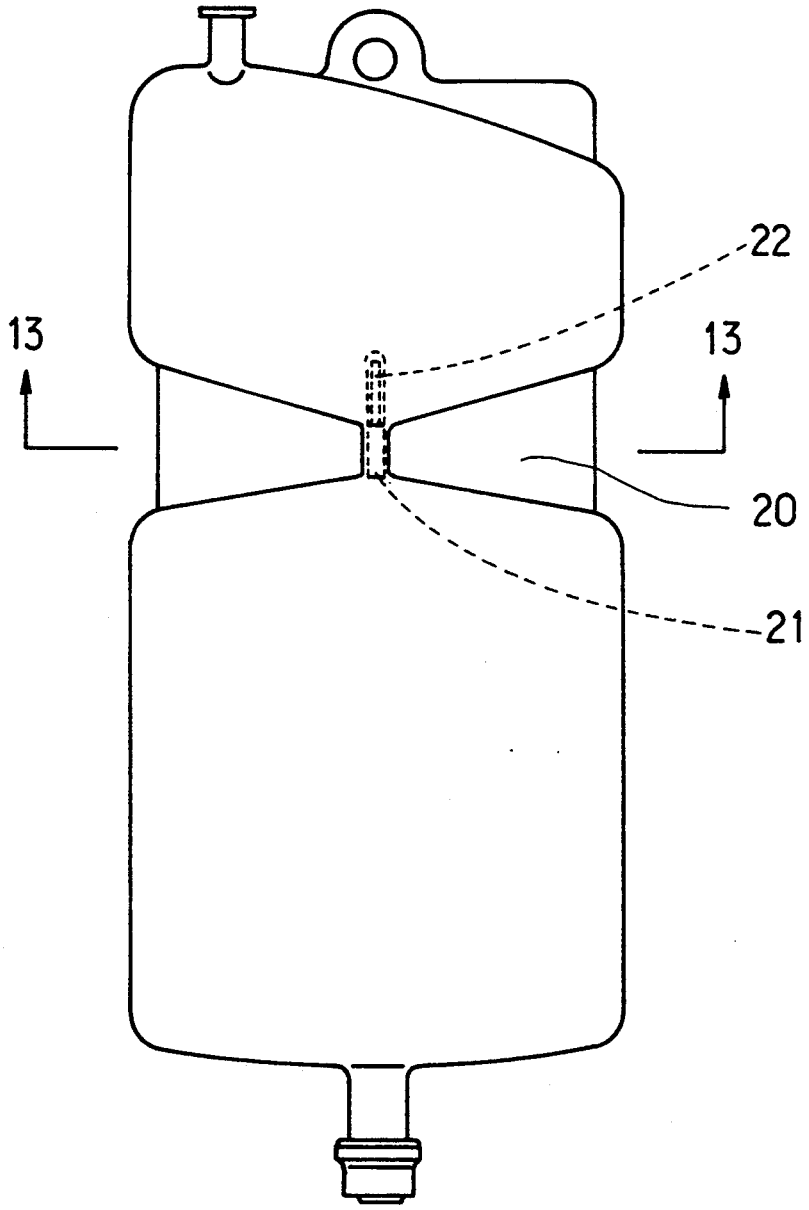
Figure 13:
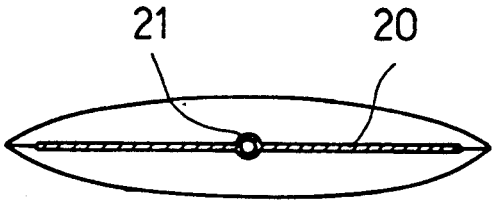
Figure 14:
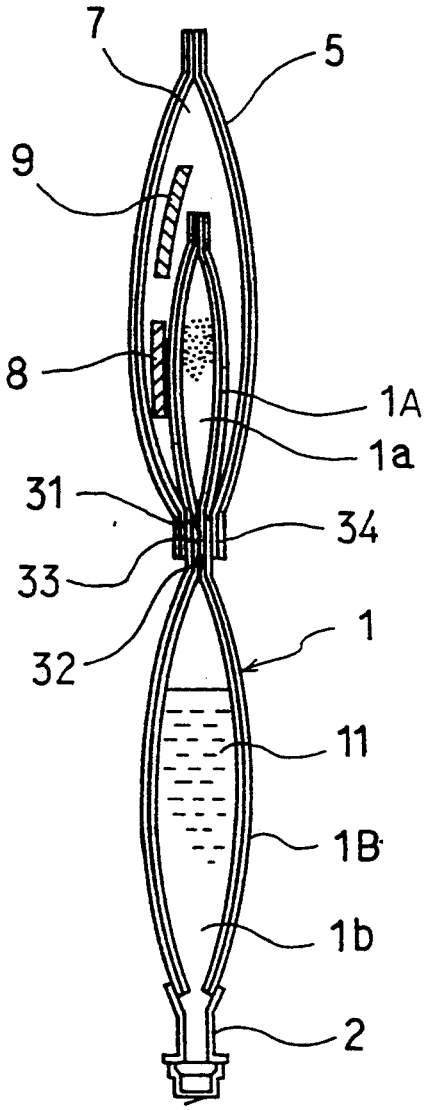
Figure 15:
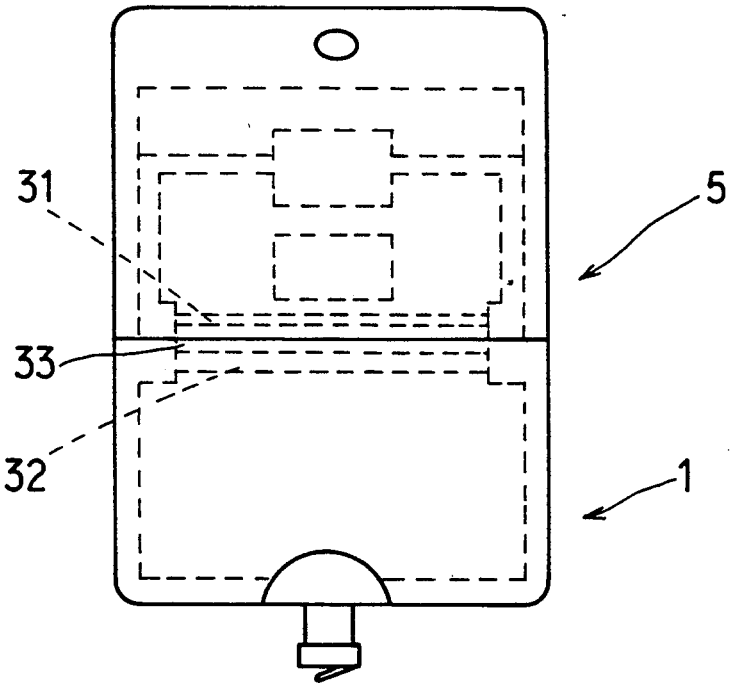
Figure 16:
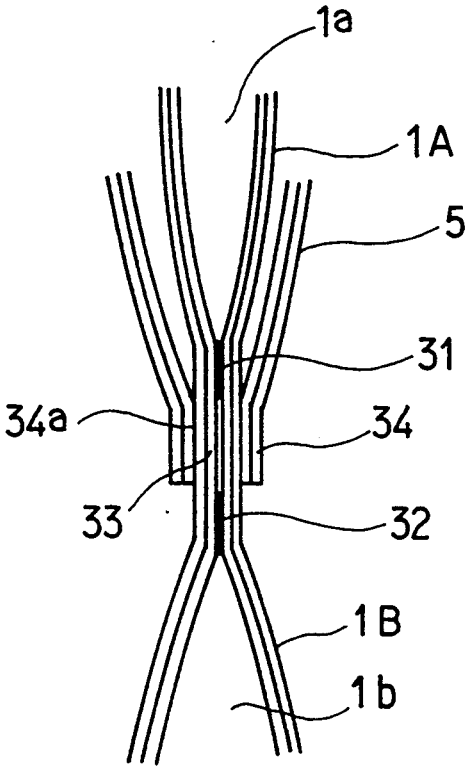
Figures 17A, 17B, 17C, 17D, 17E, 17F, 17G, 17H, 17I, 17J:
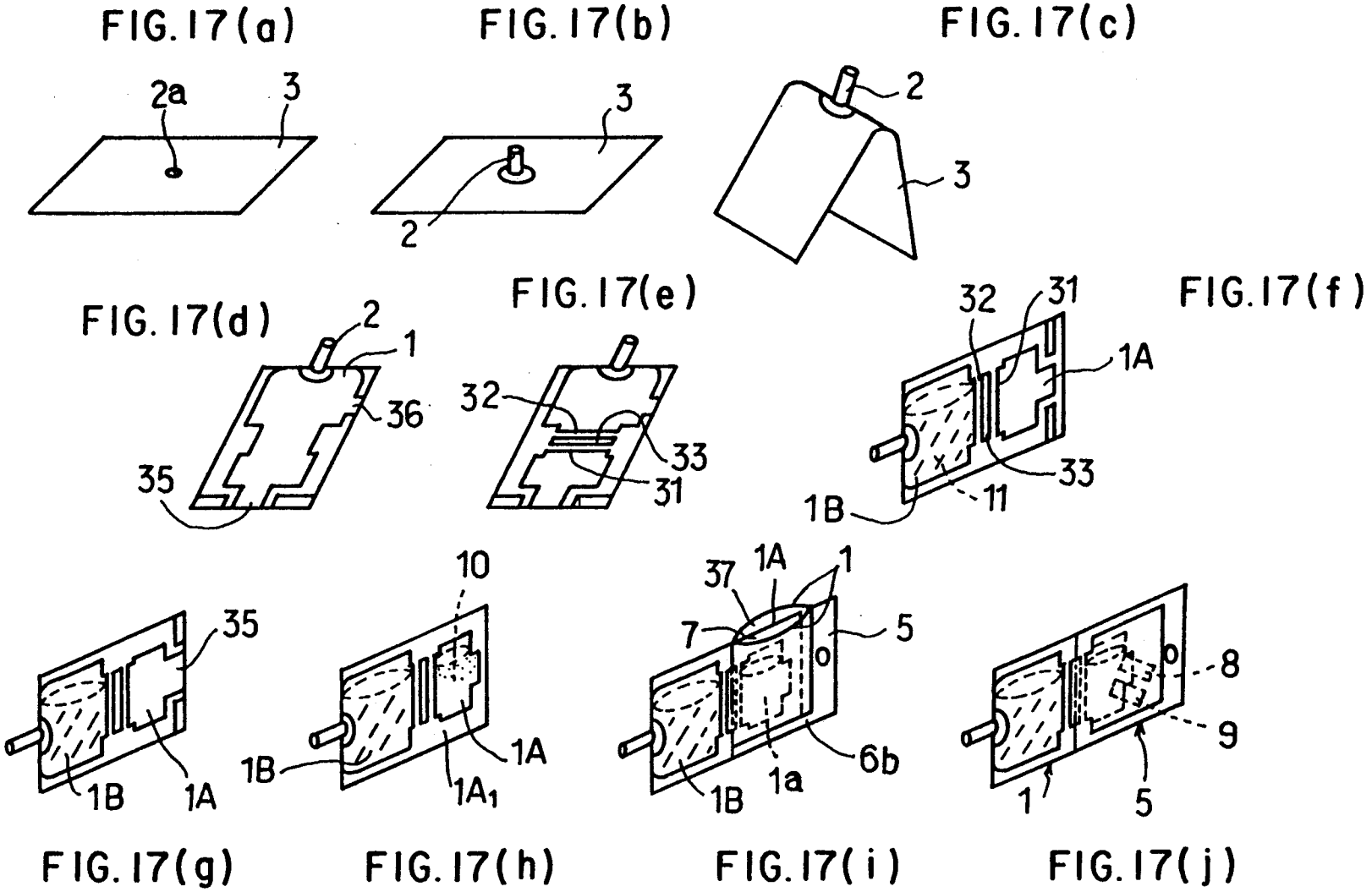
Figure 18:
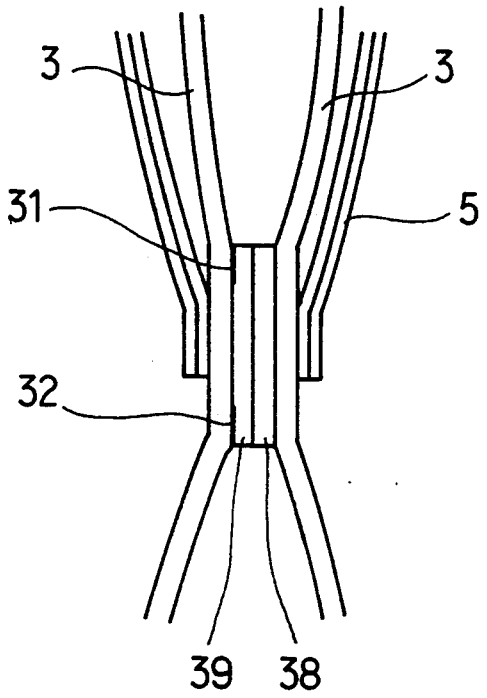
Figure 19:
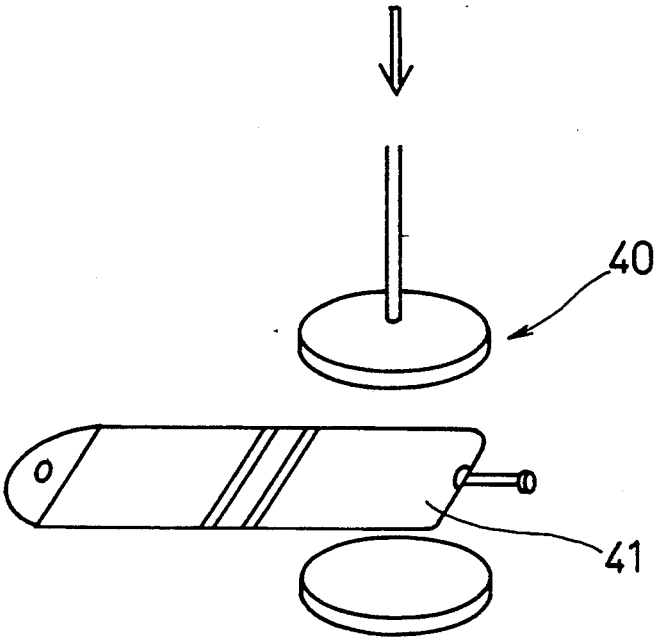

FIG. is a fragmentary sectional view showing a modification of the weak seal portion of the embodiment shown in FIG. 1;

FIG. 12 is a front view showing another modification of the weak seal portion;

FIG. 13 is a view in section taken along the line 13—13 in FIG. 12;

FIG. 14 is a view in vertical section showing an embodiment of the invention of the type having two weak seal portions;

FIG. 15 is a front view of the same;

FIG. 16 is an enlarged view in section showing the weak seal portions of FIG. 14;

FIG. 17(*a*)–(*j*) is a diagram illustrating stepwise a preferred example of process for producing the embodiment of the type having two weak seal portions;

FIG. 18 is a fragmentary enlarged view in section showing a modification of the two weak seal portions; and FIG. 19 is a diagram illustrating the embodiment of the two seal portion type as it is being tested.

BEST MODE OF CARRYING OUT THE INVENTION

Embodiments of the present invention will be described below with reference to the accompanying drawings.

Figure 2:
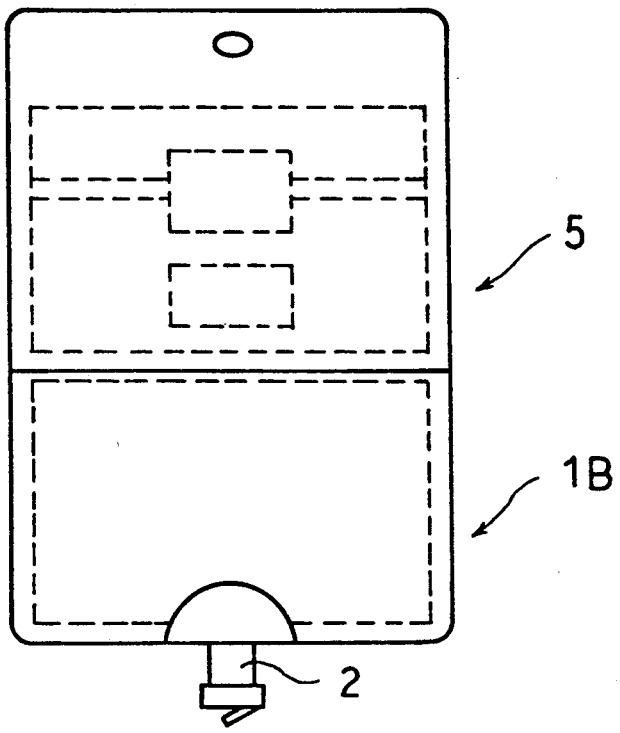
FIG. 2 is a front view of the same.

FIGS. 1 and 2 show an embodiment of the invention of the type having a single weak seal portion.

Referring to FIG. 1 showing the embodiment, indicated at 1 is a flexible plastics container body which has a discharge port 2.

The plastics container body 1 is prepared from two superposed sheets of flexible plastics film 3 by heat seal the sheets together along the outer peripheral edges thereof.

The film 3 is not a special one but is an inexpensive plastics film which is generally used for making flexible plastics containers in the field of medicine.

Figure 3:
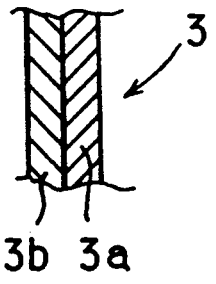
FIG. 3 is an enlarged sectional view of the portion A in FIG. 1.

FIG. 3 shows an example of film 3 comprising two layers, i.e., an outer layer 3*a* of polyethylene (hereinafter referred to simply as "PE"), and an inner layer 3*b* of a blend of PE and polypropylene (hereinafter referred to simply as "PP").

As seen in FIG. 1, the plastics container body 1 has a weak seal portion 4 extending transversely of the container at an intermediate portion of its height and formed by heat sealing.

The weak seal portion 4 is so adapted that the opposed sheets of film can be separated from each other when required by utilizing the internal pressure of the container which is increased as by pressing the container. The seal strength of the weak seal portion 4 must be smaller than that of the peripheral edge portion of the container body 1.

The interior of the plastics container body 1 is divided into upper and lower two chambers 1*a*, 1*b* by the weak seal portion 4. The upper container portion 1A forming the upper chamber 1*a* is enclosed with a cover 5, while the lower container portion 1B forming the lower chamber 1*b* is not provided with such a cover 5.

Figure 4:
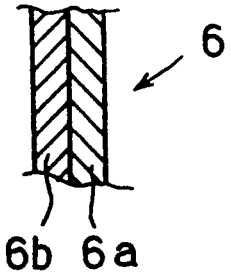
FIG. 4 is an enlarged sectional view of the portion B in FIG. 1.
Figure 5A:
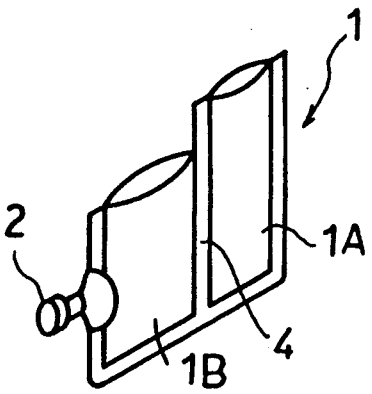
FIG. 5(*a*)–(*e*) is a diagram illustrating stepwise a preferred example of process for producing the container of the invention shown in FIG. 1.
Figure 5B:
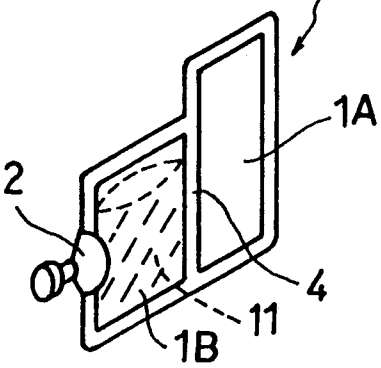
Figure 5C:
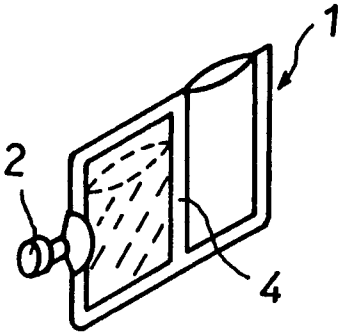
Figure 5D:
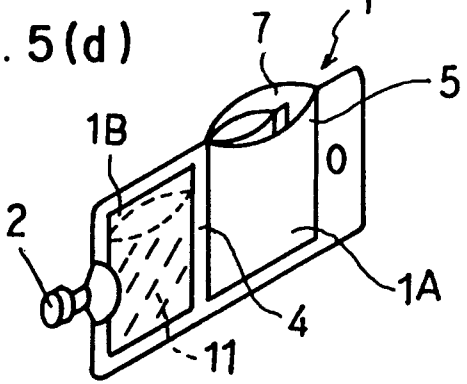
Figure 5E:
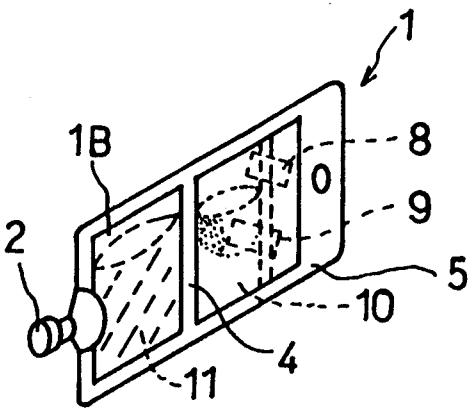

The cover 5 is made of a special film 6 which is impermeable to moisture and gas and has high gas-barrier properties. FIG. 4 shows an example of special film 6, i.e., a multi-layer film comprising an outer layer 6*a* and an inner layer 6*b* of PE, the outer layer 6*a* being composed of two layers of polyethylene terephthalate (hereinafter referred to simply as "PET") and polyvinylidene chloride. The polyvinylidene chloride forming the outer layer 6*a* may be replaced by a silicadeposited film of polyvinyl alcohol.

With reference to FIG. 1, the cover 5 comprises two sheets of special film 6 which are so arranged as to surround the upper container portion 1A. Of the peripheral portions of the sheets of film 6, the parts which are out of contact with the upper container portion 1A are heat sealed to each other, while the parts in contact with the portion 1A are heat sealed to the outer surface of the portion 1A as indicated at 6c, 6c. As seen in FIG. 1, the bonded lower edge portions 6c, 6c are in register with the weak seal portion 4.

A closed space 7 is formed between the upper container portion 1A and the cover 5 enclosing this portion 1A. A desiccant 8 and an oxygen absorber 9 are accommodated in the space 7. For example, silica gel or zeolite molding is usable as the desiccant 8. Usable as the oxygen absorber 9 are those commercially available, such as AGELESS (trademark of Mitsubishi Gas Chemical Co., Inc.) and one comprising amorphous copper. The desiccant 8 and the absorber 9 may be used in the form of an integral piece.

For example, a powder preparation 10 which is hygroscopic and/or susceptible to oxidation is accommodated within the covered upper container portion 1A, while a usual liquid preparation 11, for example, is accommodated within the coverless lower container portion 1B.

The temperature at which the seals are formed is the highest for the entire peripheral portion of the plastics container body 1 and the upper edge portion and side edge portions of the cover 5, less high for the lower edge portions of the cover 5 sealed to the container body 1, and lowest for the weak seal portion 4. Consequently, the weak seal portion 4 is the lowest of all the seals in bond strength.

FIG. 5 shows a preferred example of process for producing the present container shown in FIGS. 1 and 2. The process will be described below with reference to FIG. 5, (*a*) to (*e*).

First as shown in FIG. 5, (*a*), two sheets of plastics film shown in FIG. 3 are placed over each other so that the inner layers 3*b*, 3*b* are brought into contact with each other, and three sides of the assembly are sealed to make a plastics container body 1. Next, a weak seal portion 4 is formed at an intermediate portion of the container body, and a discharge port 2 is attached to the body. Consequently formed are an upper container portion 1A providing an upper chamber, and a lower container portion 1B separated from the portion 1A and providing a lower chamber.

Subsequently, a liquid preparation 11 is filled into the lower container portion 1B through the unsealed part thereof. As seen in FIG. 5, (*b*), the unsealed parts of the two container portions 1A, 1B are sealed, followed by heating for sterilization.

Thereafter, one side of the upper container portion 1A is then cut as seen in FIG. 5, (*c*) to open this portion, which is thereafter dried when so required.

Next as shown in FIG. 5, (*d*), a cover 5 is provided over the upper container portion 1A using the special film shown in FIG. 4. One side of the cover 5 corresponding to the open side of the upper container portion 1A is similarly left open.

Finally, a powder preparation 10 is accommodated in the upper container portion 1A, a desiccant 8 and an oxygen absorber 9 are placed into the space 7 between the upper container portion 1A and the cover 5, and the portion 1A and the cover 5 are thereafter sealed at the open side.

FIG. 5 (*e*) shows the container thus obtained and having the two chambers.

Before sealing the openings, it is desirable to replaced the air in the open spaces with nitrogen gas for the removal of oxygen.

A liquid preparation can be placed into the covered container portion 1A and a liquid or powder preparation into the coverless container portion 1B, for example, by a process similar to the foregoing exemplary process. The container accommodating these preparations can be prepared by attaching a discharge port 2 to the container body, then placing the specified preparations into the respective container portions 1A, 1B, closing the filling openings, sterilizing the contents by autoclave, then attaching a cover 5 to the upper container portion 1A, subsequently placing an oxygen absorber into the space 7 therebetween and thereafter sealing the side opening of the cover.

FIG. 6 shows another preferred example of production process different from the process of FIG. 5. This process will be described below with reference to FIG. 6, (*a*) to (*j*).

As shown in FIG. 6, (*a*), a discharge port hole 2*a* is formed in a sheet of two-layer plastics film 3 like the one shown in FIG. 3.

Next as seen in FIG. 6, (*b*), a discharge port 2 is attached by heat sealing to the outer layer, i.e., the PE layer, of the film 3 in register with the hole 2*a*. The film 3 is then folded in two along a line through the discharge port 2 as shown in FIG. 6, (*c*).

Next as shown in FIG. 6, (*d*), the two flaps of film 3 are heat sealed together at their peripheral portions at a temperature of 170° to 200° C. except at filling openings 12, 13 for a medicinal liquid preparation and a powder preparation to prepare a plastics container body 1. As shown in FIG. 6, (*f*), the filling opening 12 may be sealed and the filling opening 13 only may be left unsealed.

A weak seal portion 4 is then formed at an intermediate portion of the container body by heat sealing at a temperature of 110° to 130° C. as shown in FIG. 6, (*e*). FIG. 6, (*d*), (*e*) shows the container body as turned upside down.

Consequently, upper and lower container portions 1A, 1B are formed as partitioned by the weak seal portion 4. The medicinal liquid preparation 11 is subsequently filled into the lower container -portion 1B through the opening 13, and the two filling openings 12, 13 are thereafter heat sealed off as seen in FIG. 6, (*f*), followed by sterilization with high-pressure steam.

Next as seen in FIG. 6, (*g*), the sterilized body is externally dried, the portion of the opening 12 is cut in an aseptic atmosphere to open the opening 12 again, and clean air is applied to the interior of the upper container portion 1A through the opening 12 for drying and cleaning.

Next as shown in FIG. 6, (*h*), the powder preparation 10 is filled into the upper container portion 1A through the opening 12 under an aseptic condition, and the filling opening 12 is thereafter heat sealed off.

Next as shown in FIG. 6,(*i*), a cover 5 is provided to enclose the upper container portion 1A therewith using two sheets of special film 6 shown in FIG. 4. Preferably, one of the two film sheets is transparent, and the other sheet is nontransparent. To be suitable, the heat sealing temperature is 150° to 170° C. for the transparent sheet and about 130° to about 150° C. for the nontransparent sheet, for example, an aluminum-deposited or aluminum-covered film.

Subsequently, a desiccant 8 and an oxygen absorber 9 are placed into the space 7 between the cover 5 and the upper container portion 1A through a side opening of the cover 5, and the opening is thereafter sealed off. FIG. 6, (*j*) shows the container of the invention having two chambers and thus completed.

It is desired to replace the air in the space by nitrogen gas before the opening is sealed for the removal of oxygen.

The temperature at which the bonded joints are formed in the above process is optimally determined in accordance with the material of film used and the desired seal strength, and is not limited to the foregoing temperature ranges.

With the containers of the present invention prepared by the processes shown in FIGS. 5 and 6, the upper container portion 1A is formed by a plastics film comprising an outer layer of PE and an inner layer of blend of PE and PP, so that the container portion 1A has the disadvantage of permitting passage of moisture and gas (oxygen) although in a very small amount. However, the upper container portion 1A is provided with the cover 5 of special film having moisture- and gas-barrier properties, and the space 7 between the portion 1A and the cover 5 has accommodated therein the desiccant 8 and/or oxygen absorber 9, with the result that the cover 5 and these agents 8, 9 function to overcome the above disadvantage of the upper container portion 1A. Accordingly, a powder preparation which is hygroscopic and/or susceptible to oxidation can be preserved for a long period of time as accommodated in the upper container portion 1A although this portion is formed by plastics. The weak seal portion 4 separating the upper and lower container portions 1A, 1B is the lowest in seal strength of all the seals. Therefore, when the container portion is pressed to increase the internal pressure of the container portion, the increased pressure separates the weak seal portion 4, permitting the two container portions 1A, 1B to communicate with each other, whereby the liquid preparation and the powder preparation within the respective container portions 1A, 1B can be mixed together under an aseptic condition into a solution as contemplated.

Examples of powder preparations for use in the above embodiment are antibiotic, anti-cancer, steroid, fibrinolytic, vitamin and like preparations which are hygroscopic and susceptible to oxidation and to thermal degradation. Examples of useful liquid preparations are physiological saline, glucose solution and like dissolving solutions or diluents, and distilled water for injection. Antibiotic and like powder preparations include those which must be dissolved in sodium carbonate or like alkali solvent or other auxiliary dissolving agent before being dissolved in the liquid preparation in the lower container portion. In such a case, an injection opening (not shown) for injecting the solvent or like is provided for the chamber containing the powder preparation.

While the usual film for making the plastics container body is a multi-layer film of the construction shown in FIG. 3, also usable is a single-layer or multi-layer film prepared from at least one combination of resins selected from among PE, PP and blends of these resins. Preferably usable is a two-layer film comprising an inner layer of linear low-density polyethylene (hereinafter referred to as "LLDPE") and PP as blended therewith, and an outer layer of LLDPE. Also usable as the special film for the cover 5 is a single-layer or multi-layer sheet made of polyvinylidene chloride, PET, aluminum-deposited film, ethylene-vinyl alcohol copolymer (EVOH) and silica-deposited film. When the cover is to be heat sealed directly to the plastics container body, it is desirable to use a multi-layer film at least for the cover so that the material of the innermost layer of the cover is the same as the material of the outermost layer of the plastics container body, whereby a satisfactory seal can be formed. For example, when the outermost layer of the container body is LLDPE, it is desirable to use LLDPE for the innermost layer of the cover.

Although a powder preparation is enclosed in the chamber of the covered container portion and a liquid in the chamber of the coverless container portion according to the foregoing embodiment, the powder preparation and the liquid preparation can be-replaced by each other depending on the contemplated purpose.

A liquid preparation is accommodated in the covered container portion with a powder preparation enclosed in the other container portion, for example, in the case where the liquid preparation is an amino acid preparation or the like containing cysteine or tryptophan added thereto and susceptible to oxidation, and the powder preparation is a sugar, an electrolyte or a mixture thereof. Incidentally in this case, an oxygen absorber only is accommodated in the space between the cover and the container portion.

A liquid preparation is enclosed in the covered container portion with other liquid preparation in the other container portion, for example, in the case where the former liquid preparation is susceptible to oxidation, such as an amino acid preparation containing cysteine or tryptophan, or a vitamin preparation, and the latter liquid preparation is a sugar or electrolytic preparation.

Another example is such that the former liquid preparation is a readily oxidizable fat emulsion or the like, and the latter preparation is a sugar or electrolytic preparation.

Further it is possible to enclose a solid preparation in one of the container portions and a liquid preparation in the other container portion. Other examples of such power, liquid and solid preparations are various nutrient preparations and curing agents which are given intravenously or enterally (tube or oral feeding).

Figure 7:
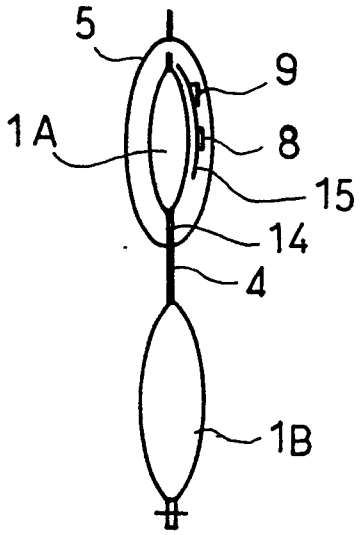
FIG. 7 is a diagram schematically showing a modification of the embodiment of FIG. 1.

Although a desiccant and oxygen absorber are accommodated in the space between the cover and the upper container portion, only one of them is usable as required. Further cover may be made locally or entirely of an aluminum-deposited film to shield the interior from light. However, it is desirable to use a nontransparent aluminum-deposited film as the barrier film for the container side where the desiccant and oxygen absorber are present. The aluminum-deposited film used for the cover may be made peelable locally or entirely when the preparation is to be used, if so desired. To assure satisfactory absorption of oxygen and desiccation of the space defined by the transparent barrier film, a hole 14 may be formed in the upper end of joint of the weak seal portion 4 as shown in FIG. 7. A nontransparent sheet 15 may be inserted as shown so as to render the desiccant 8 and the oxygen absorber 9 invisible from outside and to permit the user to readily check the solution prepared from the enclosed powder preparation. Preferably, the sheet 15 has a color readily permitting the checking of the solution in accordance with the color of the enclosed powder preparation and is perforated to assure smooth absorption of oxygen and moisture. The cover portion opposite to the side where the sheet 15 is inserted is made transparent to render the powder preparation or the like within the container portion 1A visible.

Figure 8:
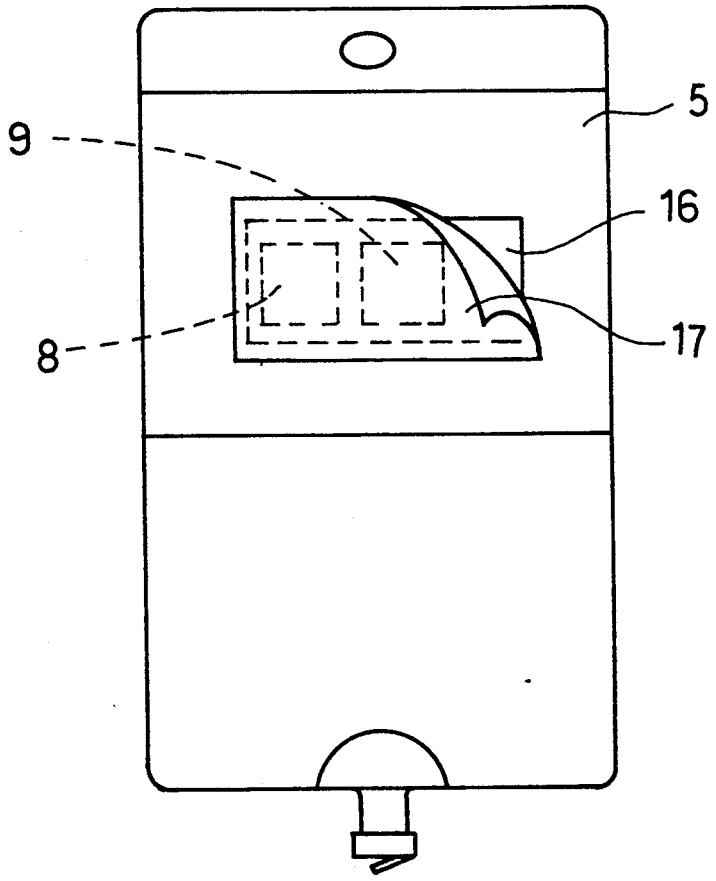
FIG. 8 is a front view showing another modification of the same.
Figure 9:
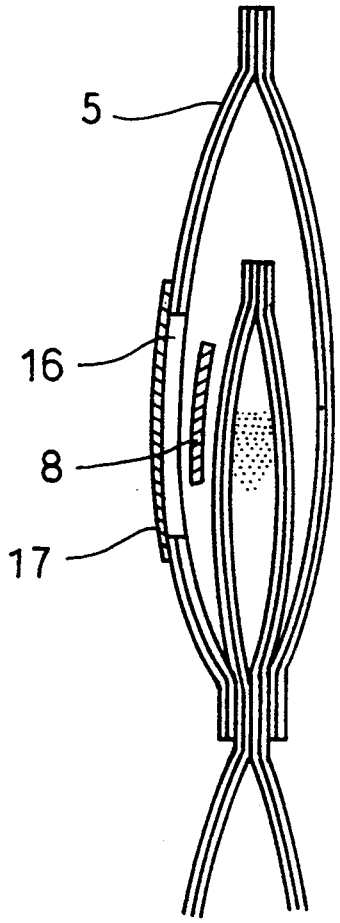
FIG. 9 is a fragmentary view in vertical section of FIG. 8.

Further as shown in FIGS. 8 and 9, the cover 5 may be formed with a withdrawing opening 16, which is removably closed with a shield sheet 17 of moisture- and gas-impermeable film, such that after the container has been used, the sheet 17 is peeled off to withdraw the desiccant 8 and the oxygen absorber 9. This assures easy disposal of wastes since the waste materials can be divided into groups according to the kind.

Figure 10:
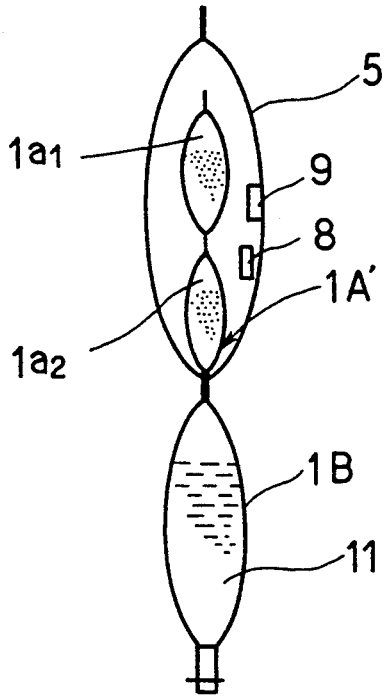
FIG. 10 is a diagram schematically showing another modification of the same.

While the foregoing embodiment is a container having two chambers for accommodating a liquid preparation and one kind of powder preparation individually, such a container can be provided with more than two chambers, for example, as shown in FIG. 10. Disposed inside the cover 5 is a container portion 1A' having chambers $1a_1$, $1a_2$ or accommodating two kinds of powder preparations (or a powder preparation and a solid preparation). A liquid preparation is accommodated in the coverless container portion 1B. It is possible to provide a plurality of chambers for liquid preparations besides powder or solid preparations.

Figure 11:
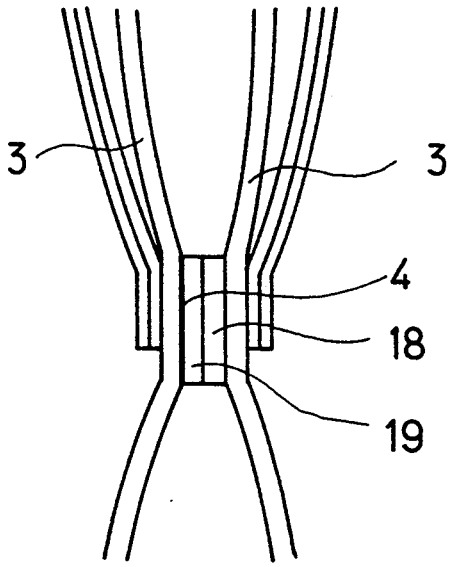

With the foregoing embodiment, the weak seal portion is formed by directly bonding together the inner layers of two sheets forming the container body. Alternatively, the weak seal portion may be formed by heat seal the two sheets together with a multi-layer insert film held therebetween. FIG. 11 shows a modification wherein two-layer insert film is used. Indicated at 3 is a container forming film which i a single-layer or multi-layer film, at 18 is a sheet having a high heat seal strength on the innermost layer of the film 3 at one side, and at 19 is a sheet having a low heat seal strength on the innermost layer of the film 3 on the other side. The film portion 3 and the sheet 19 form a weak seal portion 4. For example, when the film 3 is a single-layer film of PE or PP, the sheet 18 is made of the same material as the film 3, i.e., PE or PP, and the sheet 19 is made of a blend of PE and PP. In this example, two sheets of film 3 are fitted together and heat sealed together at the periphery in the form of a bag. However, a tubular inflation film is alternatively usable. A weak seal portion can be formed in this case by forming an aperture in the tube at an intermediate portion thereof, inserting the sheets 18, 19 into the tube through the aperture, and thereafter heat seal the tube and the sheets together as pressed from outside. Incidentally, the weak seal portion can be also formed by the direct sealing method with use of a multi-layer tubular inflation film.

A breakable plug method is usable in place of the weak seal portion serving as partition means which permits communication between the chambers when required and which is formed by the direct sealing method or multi-layer insert film sealing method. With reference to FIGS. 12 and 13, a container body made of flexible sheet is inseparably heat sealed at an intermediate portion thereof to form a partition 20 and provide two separated adjacent chambers, with a communication bore 21 formed in the partition 20. A plug 22 closed at one end is inserted in the bore 21. When the contents are to be used, the plug 22 is broken, permitting the two chambers to communicate with each other. A cover is heat sealed to the partition 20 and thereby attached to the container.

Further as the partition means substituting for the weak seal portion, a removable clip may be used for nipping the flexible sheet to thereby form parititioned two chambers (see Unexamined Japanese Patent Publication SHO 63-309263).

According to the foregoing embodiment, the two sheets of film 6 forming the cover 5 are heat sealed together directly at their peripheral portions, whereas the sheets may alternatively be sealed together with a multi-layer insert film held therebetween. Adhesive or the like is also usable for sealing.

FIGS. 14 and 15 show an embodiment of the invention having two weak seal portions.

With this embodiment, two weak seal portions 31, 32 are formed at an intermediate portion of a plastics container body 1, with a space portion 33 provided between the seal portions 31, 32. The space portion 33 is substantially unsealed.

A cover 5 has a lower edge portion 34, which is heat sealed to the space portion 33 between the weak seal portions 31, 32. FIG. 16 shows the heat sealed joint on an enlarged scale.

With the exception of the above feature, the present embodiment is not substantially different from the embodiment having the single weak seal portion shown in FIGS. 1 and 2.

According to the present embodiment, the lower edge portion 34 of the cover 5 is heat sealed to the space portion 33 between the seal portions 31, 32. This obviates the likelihood that the heat sealing operation will give an increased seal strength to the weak seal portions 31, 32.

In the case of the single seal portion type shown in FIGS. 1 and 2, the lower edge portion of the cover 5 is heat sealed to the container body 1 over the weak seal portion 4. Accordingly, it is desired to seal the edge portion under such a condition that the seal strength of the weak seal portion 4 is prevented from increasing to the greatest possible extent, or the seal portion can be easily separated free of trouble even if the seal strength is increased. Such a condition can be determined by suitably selecting the material for the cover and determining the heat sealing conditions as to temperature, time and pressure, whereas this involves considerable limitations.

In the case of the present embodiment, the lower edge portion 34 of the cover 5 can be sealed to the container body 1 without adversely affecting the seal strength of the weak seal portions 31, 32. This leads to the advantage that the material for the cover 5 and the sealing conditions are selectable with greater freedom than in the case of the embodiment of FIGS. 1 and 2.

Further with the present embodiment wherein the lower edge portion 34 of the cover 5 is sealed to the space portion 33 between the two weak seal portions 31, 32, the sealed joint **34*a* of the lower edge portion 34 is positioned at a greater distance from the chambers 1*a*, 1*b* of the container body as will be apparent from FIG. 16. This eliminates the likelihood that the heat of the sealing operation will thermally degrade the medicinal preparations accommodated in the chambers 1*a*, 1*b*. Medicinal preparations which are hygroscopic or susceptible to oxidation include many that are susceptible to thermal degradation, whereas the cover 5** lower edge portion can be heat sealed to the container body without the likelihood of thermally degrading such a preparation.

The container of the invention having the two weak seal portions and shown in FIGS. 14 and 15 is produced, for example, by the preferred process to be described below with reference to FIG. 17, (*a*) to (*j*).

As shown in FIG. 17, (*a*), a discharge port hole 2a is formed in a two-layer plastics film 3 like the one shown in FIG. 3.

Next as seen in FIG. 17, (*b*), a discharge port 2 is attached by heat seal to the outer layer, i.e., the PE layer, of the film 3 in register with the hole 2a. The film 3 is then folded in two along a line through the discharge port 2 as shown in FIG. 17, (*c*).

Subsequently as seen in FIG. 17, (*d*), the two flaps of film 3 are heat sealed together at their peripheral portions at a temperature of about 170° to about 200° C. except at filling openings 35, 36 for a medicinal preparation and powder preparation to obtain a plastic container body 1. As shown in FIG. 17, (*f*), the filling opening 35 may be sealed and the filling opening 36 only may be left unsealed.

Next as shown in FIG. 17, (*e*), two parallel weak seal portions 31, 32 are formed at an intermediate portion of the container body, with a space portion 33 provided therebetween, at a heat sealing temperature of about 110° to about 130° C. To be suitable, the weak seal portion 32 is 10 mm and the weak seal portion 31 is about 5 mm in width. FIG. 17, (*d*), (*e*) shows the container body as turned upside down.

Consequently, upper and lower container portions 1A, 1B are formed as partitioned by the weak seal portions 31, 32. The medicinal preparation 11 is subsequently filled into the lower container portion 1B through the opening 36, and the two filling openings 35, 36 are thereafter sealed off as seen in FIG. 17, (*f*), followed by sterilization with autoclave.

Next as seen in FIG. 17, (*g*), the sterilized body is externally dried, the portion of the opening 35 is cut in an aseptic atmosphere to open the opening 35 again, and clean air is applied to the interior of the upper container portion 1A through the opening 35 for drying and cleaning.

Next as shown in FIG. 17, (*h*), the powder preparation 10 is filled into the upper container portion 1A through the opening 35 under an aseptic condition, and the filling opening 35 is thereafter sealed off.

Next as shown in FIG. 17, (*i*), a cover 5 is provided to enclose the upper container portion 1A therewith using two sheets of special film 6 shown in FIG. 4. Preferably one of the two film sheets is transparent, and the other sheet is nontransparent.

To render the filled preparation 10 substantially free from heat when the film 6 is heat sealed to the edge of the upper container portion 1A, it is preferable to provide a spacing of about 5 mm between the sealed joint 6b of the film 6 and the chamber 1a in the upper container portion 1A. For this purpose, the joint $1A_2$ (see FIG. 17, (*h*)) of the periphery of the upper container portion 1A, especially at opposite side portions thereof, needs to have a width greater than 5 mm. Usually this width is about 7 to about 10 mm in view of the sealing width of the film 6.

As shown in FIG. 16, the lower edge portion 34 of the cover 5 is sealed at the position of the space portion 33 between the two weak seal portions 31, 32. The sealing temperature is about 150° to about 170° C. when the film 6 used is transparent, or 130° to 150° C. when the film used is a nontransparent aluminum-deposited film.

As seen in FIG. 17, (*i*), the cover 5 provided around the upper container portion 1A is initially open at one side thereof as indicated at 37. A desiccant 8 and an oxygen absorber 9 are placed into the space 7 between the cover 5 and the upper container portion 1A through the opening 37, and the opening 37 is thereafter sealed off. FIG. 17, (*j*) shows the container of the invention having the two chambers and two weak seal portions thus obtained. It is desired to replace the air in the opening by nitrogen gas before the opening is sealed for the removal of oxygen.

The weak seal portions 31, 32 are formed by pressing a heated die against the container body with a cylinder device. The die for forming the seal portions has two ridges the temperature of which is adjustable with an electric heater and which are movable upward and downward by the cylinder device.

With the foregoing embodiment, the heat sealing temperature for forming each joint is selectively set to an optimum temperature range in accordance with the material of the film concerned and the contemplated seal strength. Accordingly, the sealing temperature ranges given above are in no way limitative.

In the foregoing exemplary process, the weak seal portions are formed by directly sealing together the inner surfaces of two sheets forming the container. Alternatively, the week seal portions may be formed by heat seal the two sheets together with a multi-layer insert film held therebetween. FIG. 18 shows a modification wherein two-layer insert film is used. Indicated at 3 is a container forming single-layer or multi-layer film, at 38 a sheet having a high seal strength on the innermost layer of the film 3 at one side, and at 39 a sheet having a low seal strength on the innermost layer of the film 3 at the other side. The film 3 and the sheet 39 provide the weak seal portions 31, 32. For example when the film 3 is a single-layer film of PE or PP, the sheet 38 is made of the same material as the film 3, i.e., PE or PP, and the sheet 39 is made of a blend of PE and PP. The insert film may be divided in two for the weak seal portion 31 and the weak seal portion 32. The cover 5 may be sealed to the film 3 simultaneously with the sealing of the multi-layer insert film. Similarly to the embodiment of the type having a single weak seal portion, the weak seal portions can be formed by the direct sealing method or multi-layer insert film sealing method using a single- or multi-layer tubular inflation film in place of the plastics film 3 used for forming the container body 1.

Although the present invention has been described above with reference to several embodiments, the invention is in no way limited to these embodiments but can of course be practiced in various modes within the scope of the invention.

Containers of the invention having two weak seal portions were tested for the opening of the seal portions, i.e., for the force required to open the weak seal portions and for variations in the force. The containers had two chambers for use with a usual parenteral solution, and barrier film (cover) heat sealed to the space portion between the two seal portions.

For the preparation of each container, a transparent barrier film forming one side of the cover was sealed to the front side of each container at a heater plate temperature of 160° C. for 5 seconds, and an aluminum barrier film forming the other side of the cover to the rear side thereof at a die temperature of 160° C. for 2 seconds. The force required to open the weak seal portions was measured by the following method.

A compression jig 40, 100 mm in diameter, was attached to a tension-compression tester, Strograph-M2, product of Toyo Seiki Seisakusho Co., Ltd., and was pressed against the solution container portion 41 of the container at a rate of 50 mm/min as shown in FIG. 19. The pressure acting on the jig when the seal portions were opened was measured. The container was made of a two-layer film comprising an inner layer of a blend of LLDPE and PP in the ratio of 2:1, and an outer layer of LLDPE. A liquid (100 ml) was enclosed in the solution container portion. The initial force to open the weak seal portions was set to 30 kg.

Table 1 shows the result.

TABLE 1

| Seal opening force (kg) | | | | | | | | |
|---|---|---|---|---|---|---|---|---|
| n1 | n2 | n3 | n4 | n5 | n6 | n7 | Average | Standard deviation |
| 24 | 34 | 33 | 31 | 32 | 30.5 | 28 | 30.36 | 3.55 |

The test result indicates that the container of the present invention can be low in the opening force which is a definite value of about 30 kg for seven container samples, is diminished in variations in this force, and is therefore assured of easy-to-peel openability.

We claim:

1. A container having a plurality of chambers for accommodating a liquid, powder or solid, wherein the container comprises:

a flexible container body made of plastics;

said flexible container body having a plurality of container portions defining a plurality of chambers, each of the container portions defining the entire exterior surface of a respective one of said chambers;

partition means for dividing the container into the chambers and permitting communication between the chambers when required;

at least one of the container portions having generally no cover;

at least one covered container portion having a cover;

the cover enclosing the at least one covered container portion forming a closed space which extends around substantially the entire at least one covered container portion thereby enclosing the at least one chamber defined by said at least one covered container portion;

said cover being made of a flexible film having barrier properties against moisture and gas, the closed space being adapted to accommodate therein at least one of a desiccant and an oxygen absorber.

2. A container as defined in claim 1, wherein the partition means comprises at least one weak seal portion easily openable by applying an external pressure to at least one of the container portions to increase the internal pressure of the chamber therein.

3. A container as defined in claim 2, wherein the partition means comprises one weak seal portion separating at least two chambers.

4. A container as defined in claim 2, wherein the partition means comprises two weak seal portions separating at least two chambers with a substantially unsealed space portion provided between said at least two chambers.

5. A container as defined in claim 4, wherein the cover has a lower end portion heat sealed to the space portion between the two weak seal portions.

6. A container as defined in claim 2, wherein the weak seal portion includes heat sealed opposed inner surfaces of a flexible plastics film forming the container body.

7. A container as defined in claim 2, wherein the weak seal portion includes heat sealed opposed inner surfaces of a flexible plastics film forming the container body, with an insert film held between the opposed inner surfaces.

8. A container as defined in claim 2, wherein said cover is sealed to said flexible container body at a first outside surface thereof at a first side of said weak seal portion and at a second outside surface of said flexible container body at an opposite side of said weak seal portion.

9. A container as defined in claim 2, wherein said covered container portion includes two plastic sheets sealed at perimeter edges and at said at least one weak seal portion, and wherein said cover is sealed to an outside surface of a first of the sheets at the at least one weak portion, extends around the entire covered container and is sealed to an outside surface of the second of the sheets at the opposite side of said at least one weak portion.

10. A container as defined in claim 9, wherein said at least one weak portion is a single sealed portion which extends substantially across the width of said flexible container body.

11. A container as defined in claim 9, wherein said sheets are each multi-layer sheets.

12. A container as defined in claim 1, wherein a powder is accommodate in the at least one chamber defined by the at least one covered container portion, and wherein a liquid is accommodated in the at least one chamber defined by the at least one coverless container portion.

13. A container as defined in claim 1, wherein a liquid is accommodated in the at least one chamber defined by the covered container portion, and wherein a power is accommodated in the at least one chamber defined by the at least one coverless container portion.

14. A container as defined in claim 1, wherein a liquid is accommodated in the at least one chamber defined by the at least one covered container portion, and wherein another liquid is accommodated in the at least one chamber defined by the at least one coverless container portion.

15. A container as defined in claim 1, wherein said closed space contains at least one member from the group consisting of a desiccant and an oxygen absorber located therein.

16. A container as defined in claim 15, wherein said closed space contains both a desiccant and an oxygen absorber located therein.

17. A container having a plurality of chambers for accommodating a liquid, powder or solid, wherein the container comprises:

a flexible container body made of plastics and having a plurality of separate sealed chambers;

partition means for dividing the container into the chambers and permitting communication between the chambers when required;

at least one of the sealed chambers being substantially uncovered;

at least one of the sealed chambers having a cover;

the cover enclosing the at least one covered sealed chamber forming a closed space extending around substantially the entire at least one covered sealed chamber, said cover thereby enclosing said at least one sealed chamber; and said cover being made of a flexible film having barrier properties against moisture and gas, the closed space being adapted to accommodate therein at least one of a desiccant and an oxygen absorber.

18. A container for accommodating a liquid, powder or solid, said container comprising:

a flexible container body being made of plastic sheet material, having peripheral sealing means and partition sealing means for sealing said sheet material so as to define sealed chambers, each chamber being defined by said peripheral sealing means and said partition sealing means and having opposed exterior sheet faces, said partition sealing means adapted to be unsealed to permit communication between said chambers;

a cover sealingly enclosing at least one of said chambers to define an additional chamber enclosing said at least one chamber;

said cover being made of a flexible film having barrier properties against moisture and gas, the additional chamber being adapted to accommodate therein at least one of a desiccant and an oxygen absorber; and at least one of said chambers being generally uncovered.

19. A container for accommodating a liquid, powder or solid, said container comprising:

a flexible container body being made of plastic sheet material, having peripheral sealing means and partition sealing means for sealing said sheet material so as to define sealed chambers, each chamber being defined by said peripheral sealing means and said partition sealing means and having opposed exterior sheet faces, said partition sealing means adapted to be unsealed to permit communication between said chambers;

a cover sealingly enclosing at least one of said chambers to define an additional chamber enclosing said at least one chamber;

at least one of a desiccant and an oxygen absorber being located in said additional chamber; and at least one of said chambers being generally uncovered.

* * * * *